US005315984A

United States Patent [19]

Bauer

[11] Patent Number: 5,315,984

[45] Date of Patent: May 31, 1994

[54] THROUGH THE WALL INSULATED FLUE

[75] Inventor: Gerald Bauer, Marshfield, Wis.

[73] Assignee: FACSA, Inc., Spencer, Wis.

[21] Appl. No.: 14,555

[22] Filed: Feb. 8, 1993

[51] Int. Cl.[5] ..... F23J 13/00

[52] U.S. Cl. ..... 126/317; 126/314; 126/307 R

[58] Field of Search ..... 126/314, 315, 316, 317, 126/56, 82, 85 B, 312, 307 R; 34/235; 454/359, 363, 44, 347, 353

[56] References Cited

U.S. PATENT DOCUMENTS

| | | | |
|---|---|---|---|
| 441,644 | 12/1890 | Conderman | 126/317 |
| 576,899 | 2/1897 | Scott | 126/317 |
| 2,754,748 | 7/1956 | Daggett | 454/359 |
| 2,841,071 | 7/1958 | Strawsine | 126/314 X |
| 3,056,397 | 10/1962 | Little | 126/116 B |
| 3,136,309 | 6/1964 | Martz | 126/116 B |
| 3,308,808 | 3/1967 | Malafouris | 126/314 |
| 4,237,621 | 12/1980 | Boismenu | 34/235 X |
| 4,543,942 | 10/1985 | Bauer et al. | 126/314 |

*Primary Examiner*—Carl D. Price

[57] ABSTRACT

A through the wall insulated flue for low temperature venting of radiant heat from igniting combustibles produced by wood pellet, kerosene, fuel oil appliances such as stoves and hot water heaters. The flue assembly includes a protective metal tube, housing a ceramic insulated sleeve that is adapted to surround a flue pipe connected to the appliance, with the tube and insulating sleeve being of a length to be journalled through the wall for venting of the radiant heat. An inside wall plate and a complimentary outside wall plate provide necessary receiving collars for the opposite ends of the tube and insulating sleeve and function to correctly position them from internal wall structures.

4 Claims, 1 Drawing Sheet

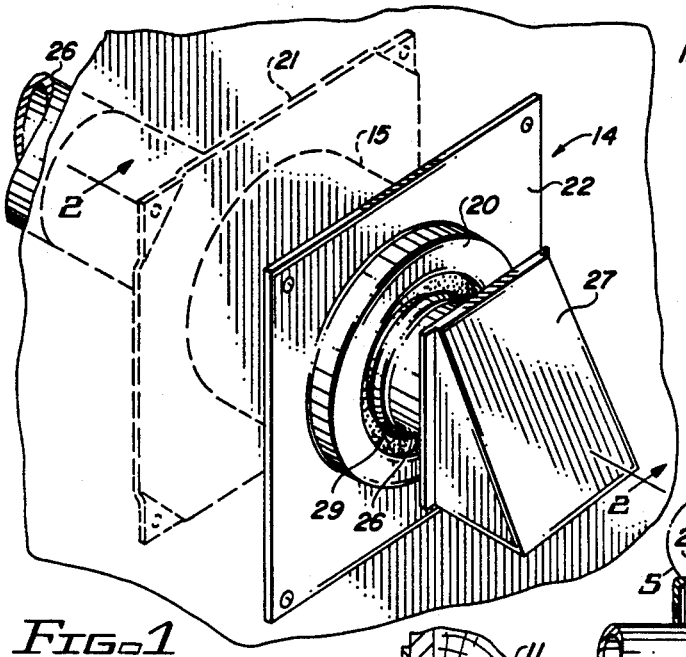
FIG. 1
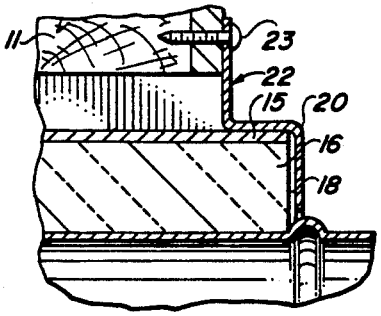
FIG. 4
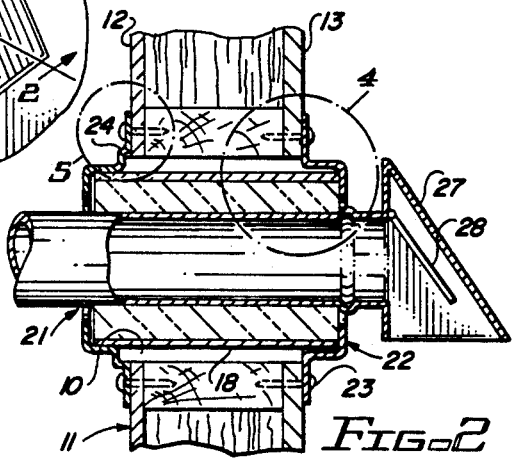
FIG. 2
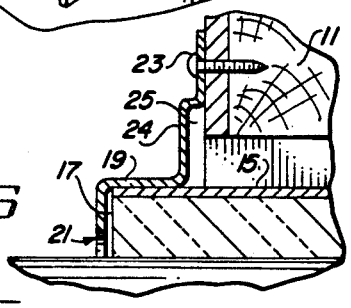
FIG. 5
FIG. 3
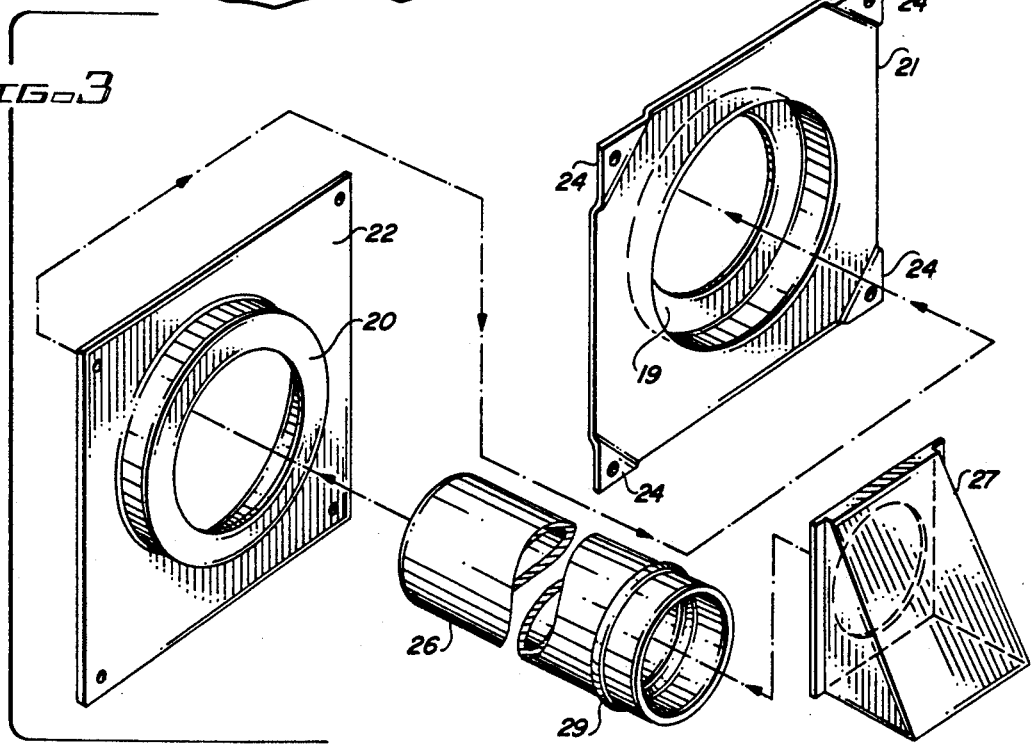

THROUGH THE WALL INSULATED FLUE

BACKGROUND OF THE INVENTION

Prior through the wall stovepipe installations were primarily adaptable for use with solid fuel, such as wood or coal and thus were required to be associated with an upstanding chimney, thus necessitating insulation only along the junction between the stove and the chimney. As an example of such prior assembly see U.S. Pat. No. 4,543,942, dated Oct. 1, 1985 and the references cited therein.

These prior devices not only required insulation against one structural wall but insulation along the stove pipe itself as it came within the proximity of such wall, with the insulation penetrating into the upright chimney. Thus these assemblies were expensive to manufacture and difficult to install.

SUMMARY OF THE INVENTION

This invention relates to a flue assembly adapted to reduce the danger of radiant heat from vent pipes associated with igniting combustibles. The flue assembly is particularly adaptable for through the wall installation and for usage on the vent pipe of a wood pellet, kerosene, gas or fuel oil burning appliances.

The invention consists of a insulating sleeve constructed from a composition including ceramic fibers and a binder which avoids the use of any asbestos or formaldehyde. A metal protective tube, houses the insulating sleeve and is formed to be of a length to extend throughout the width of the wall into which it is projected.

Inside and outside wall plates are provided and each present a recessed receiving collar which are designed to receive and secure the opposite ends of the tube and insulated sleeve. The inside wall plate has all of its four corners crimped such that when they are positioned upon the surrounding wall structure of the flue opening they will maintain a predetermined air space between the wall plate and the wall.

A vent pipe is adapted to be journalled in the insulated sleeve and at its exterior end carries a damper and weather cap. This pipe has a circumferentially extending bead formed therein which is adapted to be positioned against the outer surface of the outside wall plate so as to maintain proper spacing between the outer house wall surface and the flue and weather cap carried thereby.

It is an object of this invention to provide an insulated sleeve for through the wall stove pipe insulation while permitting easy access to the stove pipe for cleaning, inspection and/or replacement if necessary.

Yet another object of the invention is to provide a through the wall insulated flue that is economical to manufacture, easy to install and one which is highly efficient for its stated purpose.

Other objects will appear hereinafter and be readily apparent from the following detailed description of the invention.

A BRIEF DESCRIPTION OF THE DRAWINGS

The invention will be best understood by reference to the accompanying drawings, showing the preferred construction and mode of assembly of the invention by which the stated objects thereof are achieved, and in which:

FIG. 1 is a fragmentary perspective view of the through the wall insulated flue of this invention in an assembled condition;

FIG. 2 is a fragmentary detailed sectional view of the through the wall insulated flue in its assembled condition;

FIG. 3 is a perspective view of the related structural parts of the invention;

FIG. 4 is an enlarged detailed sectional view of the designated portion of FIG. 2, and FIG. 5 is an enlarged detailed sectional view of the designated portion of FIG. 2.

GENERAL DETAILED DESCRIPTION OF THE INVENTION

The through the wall insulated flue of this invention is adapted to be installed through opening 10 made in the structural wall 11 as illustrated in FIG. 2. This arrangement presents an interior wall 12 and exterior wall 13 which is the structure to be insulated from the radiant heat passing through the stove pipe of the appliance.

The flue assembly 14 consists of a metallic protective tube 15 which embraces a insulating sleeve 16. The tube 15 and sleeve 16 are of a length greater than the width between the interior wall 12 and exterior wall 13, and of a diameter less than the opening 10. The insulating sleeve 16 is constructed from ceramic fibers bound together by a suitable binder. By the use of ceramic fibers for the insulation properties required there is no need for asbestos or formaldehyde.

As the length of the tube 15 and sleeve 16 is greater than the space between the interior wall 12 and exterior wall 13, they present protruding ends 17 and 18. These ends 17 and 18 are adapted to be secured in outwardly protruding circular collars 19 and 20 formed in the bodies of inside and outside wall plates 21 and 22 respectively. These wall plates 21 and 22 are generally rectangular in shape and provide central openings, and are of a size to completely overlay the opening 10 cut in the wall 11, and are fastened at their corners to the respective walls by screws 23 or the like.

It should be noted that the inside wall plate 21 has its corners crimped as at 24, with the crimped corners 24 constituting the only portion of the wall plate 21 abutting the surface of the interior wall 12 when the plate 21 is positioned over the opening 10. By reason of the displacement of the plate 21 from the wall 12 a circulating air space 25 is obtained between the interior wall surface 12 and the inner wall plate 21 (see FIG. 5). With the tube 15 and sleeve 16 secured in the collars 19 and 20, the tube 15 and sleeve 16 are firmly held in place free from any direct contact with the supporting wall structure 11.

A vent pipe 26 is adapted to be projected through the insulating sleeve 16 as clearly shown in FIGS. 1 and 2. The exterior end of the vent pipe 26 will support a vent cap 27 and damper 28. A circumferentially extending bead 29 formed in the pipe 26 will be made to contact the outer surface of the insulating sleeve 16 exposed through the opening formed by the collar 20 of the wall plate 22 to positively space the cap 27 and damper 28 from the fixed wall structure.

From the foregoing there has been described a insulated flue assembly that is generally adaptable for use with non-solid fuel burning apparatuses such as pellet stoves, kerosene fuel oil stoves and hot water heaters. The protected and isolated ceramic insulating sleeve reduces the danger of combustion from radiant heat being vented through the vent pipe. The ceramic sleeve does away with the need of asbestos or formaldehyde insulation. By the geometries of size and spacing the unit will maintain a minimum air space clearance between the insulated sleeve and external combustible material, with the sleeve held firmly in place once properly installed.

While I have illustrated and described the preferred form of construction for carrying my invention into effect, this is capable of variation and modification without departing from the spirit of the invention. I therefore, do not wish to be limited to the precise details of construction as set forth, but desire to avail myself of such variations and modification as come within the scope of the appended claims.

Having thus described my invention what I claim as new and novel and desire to protect by Letters Patent is:

1. An insulated flue assembly for installation in a wall opening and adapted for use with non-solid fuel burning appliances, comprising:

a) an insulating sleeve projected through and extending beyond the wall opening, b) a sleeve protecting tube of a length equal to said sleeve for embracing said sleeve in the wall opening, c) a pair of substantially square wall plates adapted to support the opposite ends of said sleeve and said tube in the wall opening, d) collar means provided by confronting surfaces of said wall plates for receiving opposite ends of said protective tube and said insulating sleeve for securing said tube and said sleeve in the wall opening, e) means in the form of offset crimps formed in each corner of the confronting surface of one of said plates with said crimps providing limited contact of said one of said plates around the wall opening and for spacing said one of said plates from the wall opening to provide a circulating air passage circumscribing said tube and said sleeve, and f) a vent pipe providing at one end a weather cap and damper and adapted for projection through said insulated sleeve and beyond said wall plates for venting radiant heat therethrough.

2. An insulated flue assembly as defined by claim 1 including means on said vent pipe for spacing said weather cap and damper from one said of wall plates.

3. An insulated flue assembly as defined by claim 1 wherein said insulating sleeve is constructed from ceramic fibers.

4. An insulated flue assembly as defined by claim 1 wherein said means on said vent pipe for spacing said weather cap and damper from one end of said insulating sleeve is a circumferentiually extending bead.

* * * * *